United States Patent [19]

Matsukura et al.

[11] Patent Number: 4,855,693

[45] Date of Patent: Aug. 8, 1989

[54] DIELECTRIC FILTER AND A METHOD OF MANUFACTURE THEREOF

[75] Inventors: Hisao Matsukura; Osamu Yamato; Hiroyuki Horii, all of Tokyo, Japan

[73] Assignee: Oki Electric Industry Co., Ltd., Tokyo, Japan

[21] Appl. No.: 227,874

[22] Filed: Aug. 3, 1988

[30] Foreign Application Priority Data

Aug. 8, 1987 [JP] Japan ..... 62-198873

[51] Int. Cl.[4] ..... H01P 1/202

[52] U.S. Cl. ..... 333/202; 333/206; 333/207; 333/222; 333/223

[58] Field of Search ..... 333/202, 206, 207-212, 333/219, 219.1, 222, 223, 235

[56] References Cited

U.S. PATENT DOCUMENTS 4,742,562 5/1988 Kommrusch ..... 333/206 X
4,768,003 8/1988 Kawakami et al. ..... 333/202

FOREIGN PATENT DOCUMENTS 58-179002 10/1983 Japan .

*Primary Examiner*—Eugene R. LaRoche
*Assistant Examiner*—Seung Ham
*Attorney, Agent, or Firm*—Spencer & Frank

[57] ABSTRACT

A dielectric filter and a method of manufacture. The filter includes a block of ceramic material having one or more holes extending from a top surface to a bottom surface, each of which is interiorly covered with conductive material so as to form an inner conductive layer. The bottom surface and side surfaces of the block are also covered with bottom and side conductive layers electrically connected to the inner conductive layers at the bottom surface. The inner conductive layer is further connected to spaced apart top conductive layer portions provided on the top surface of the block surrounding each hole. The top layer portions are spaced from each other and have an oblique edge portion which is capacitively coupled with, and obliquely faces an upper edge portion of the side conductive layers, the oblique edge facilitating adjustment of the resonant frequency by removal of a predetermined amount of conductive material therefrom. In accordance with the method of manufacture of this filter, the filter is initially constructed to have a resonant frequency which is greater than that ultimately desired, and after measuring the resonant frequency initially obtained, a predetermined amount of conductive material is removed from the top conductive layer at a location along the oblique edge portion according to the required reduction in resonant frequency in order to reduce the resonant frequency to a desired value.

21 Claims, 5 Drawing Sheets

DIELECTRIC FILTER AND A METHOD OF MANUFACTURE THEREOF

BACKGROUND OF THE INVENTION

The present invention relates to a dielectric filter comprised of ceramic material, and more particularly to a dielectric filter and its method of manufacturer, to which radio frequency signals (hereinafter referred to as RF signals) having a frequency from the ultra high frequency (UHF) bands to the relatively low frequency microwave bands can be coupled, and which is well adapted for a bandpass filter coupling to RF signals having either of the frequency ranges from 825 MHz to 845 MHz or from 870 MHz to 890 MHz, which are used by mobile telephones.

A dielectric filter must be tuned after the filter is initially constructed and tested. A conventional dielectric filter structure whose frequency response may be finely adjusted is described in detail in U.S. Pat. No. 4,431,977 and Japanese laid-open Patent Publication No. 84-128801. A fine frequency adjustment of the filter described in U.S. Pat. No. 4,431,977 is performed by removing an amount of the conductive material from around the conductor-lined holes formed in the dielectric material, the amount of the material removed determining the amount of adjustment.

There has been a continuing effort, particularly in the field of mobile telephones, to reduce the size of the filters. A problem arises, however, in reducing the size of a filter which is tunable in the manner of the prior art because the amount of conductive material to be removed for a given adjustment will be necessarily decreased, and thus the removal process is more sensitive and therefore more time consuming and expensive.

Another adjustment approach which is described in Japanese laid-open Patent Publication No. 84-128801 is to perform the fine frequency response adjustment of the filter by cutting conductive strip lines which are provided on the top surface, surrounding the holes. This other adjustment approach may be used to finely adjust the frequency response of the filter. However, it has been found that with this approach, portions of the ceramic material provided between the holes and the strip lines reduce the unloaded Qu of the filter.

SUMMARY OF THE INVENTION

Accordingly, it is an object of the present invention to provide an improved dielectric filter whose frequency response can be finely adjusted without reduction of the unloaded Qu of the filter.

It is another object of the present invention to provide an improved dielectric filter which can be easily tuned and is well adapted for automatic tuning.

The dielectic filter of the present invention includes a block of ceramic material having one or more holes extending from a top surface to a bottom surface, each of which is interiorly covered with conductive material so as to form an inner conductive layer. The bottom surface and side surfaces of the block are similarly covered with bottom and side conductive layers electrically connected to the inner conductive layers at the bottom surface. The inner conductive layer is further connected to spaced apart top conductive layer portions provided on the top surface of the block surrounding each hole. The top layer portions are spaced from each other and have an oblique edge portion which is capacitively coupled with, and obliquely faces an upper edge portion of the side conductive layers.

As with the known methods of manufacture of dielectric filters (such as are disclosed in U.S. Pat. No. 4,431,977 and Japanese laid-open Patent Publication No. 84-128801), the filter is designed to initially have a resonant frequency which is greater than that ultimately desired, and after measuring the resonant frequency initially obtained, a portion of the top conductive layer is removed in order to reduce the resonant frequency to a desired value.

However, the amount by which the resonant frequency is reduced by removing a portion of the top conductive layer depends not only on the amount of material removed, but also on the distance from the removed portion to the opposing upper edge portion of the side layer. Therefore, the resonant frequency of the filter can be, and in accordance with the method of the invention is, reduced by a predetermined amount by selection of a location along the oblique edge portion appropriate to the amount of reduction required for removal of a predetermined amount of conductive material.

In accordance with another aspect of the invention, the oblique edge portion of the top conductive layer is straight or uniformly staircase-shaped and the upper edge portion of the side layer is straight, so that the distance between them changes in a linear or uniformly incremental manner. This facilitates the selection of the appropriate location for the removal of conductive material depending on the amount by which the resonant frequency must be reduced.

Each portion of the block of ceramic having such a hole surrounded by a top conductive layer portion, and having an interior conductive layer and bottom and side conductive layers, defines a dielectric resonator whose resonant frequency is reduced by removing a portion of the top conductive layer portion.

BRIEF DESCRIPTION OF THE DRAWINGS

These and other features and advantages of the invention will be more completely understood from the following detailed description of the preferred embodiments with reference to the accompanying drawings in which.

DETAILED DESCRIPTION OF THE PREFERRED EMBODIMENT

Figure 1:
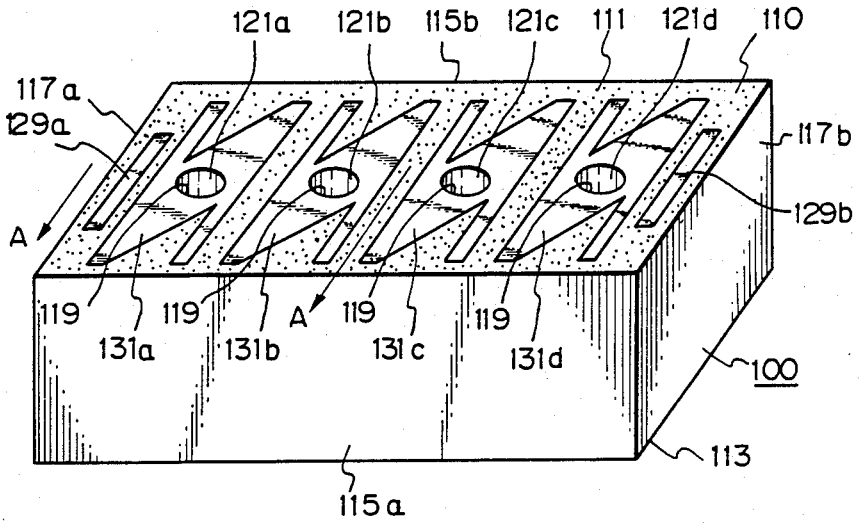
FIG. 1 is a perspective view of a first embodiment of a dielectric filter in accordance with the present invention.

Referring to FIG. 1, there is illustrated a dielectric filter 100 embodying the present invention.

The filter 100 includes a substantially rectangularly shaped block 110 of ceramic materials, primarily BaO and $TiO_2$. The block 110 has a top surface 111, a bottom surface 113, a pair of mutually parallel first side surfaces 115*a* and 115*b* and a pair of mutually parallel second side surfaces 117*a* and 117*b*. The block 110 further has four cylindrical interior surfaces 118 therein which respectively define corresponding holes 119 each extending from the top surface 111 to the bottom surface 113 and arranged in a vertical plane parallel to the first side surfaces 115*a* and 115*b*. Each of the interior surfaces in the block 110 is entirely covered with a layer of a conductive material such as a silver or copper so as to form inner conductive layers 121*a*, 121*b*, 121*c* and 121*d* as shown in FIG. 2, which is a cross section of the dielectric filter 100 in FIG. 1 taken along lines A—A.

Figure 2:
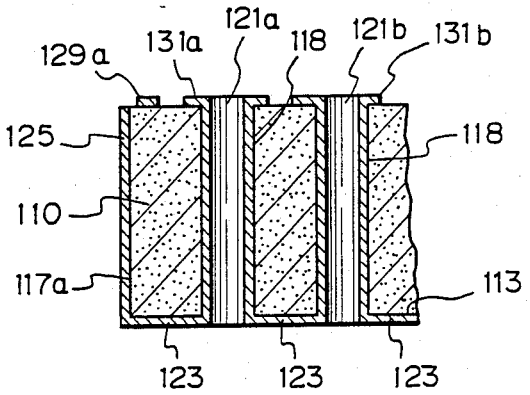
FIG. 2 is a cross section of the dielectric filter shown in FIG. 1, taken along lines A—A.

Referring to FIG. 2, the inner conductive layers 121*a*–121*d* are electrically connected with one another by means of a bottom conductive layer 123 which may also be formed, for example of silver or copper on the bottom surface 113 of the block 110. The bottom conductive layer 123 is electrically connected with similarly formed side conductive layers 125 provided on the side surfaces 115*a*, 115*b*, 117*a* and 117*b*.

Each of the four inner conductive layers, surrounded by the dielectric material enclosed in the side and bottom conductive layers, acts as a dielectric resonator which is resonant with predetermined RF signals inputted from an input electrode 129*a* and outputted to an output electrode 129*b*.

The four resonators have respective top conductive layers 131 on the top surface 111, designated layers or layer portions 131*a*, 131*b*, 131*c* and 131*d*. The top conductive layers 131*a*–131*d* respectively form collars covering the portions of the top surface 111 surrounding the four corresponding holes 119 and are respectively connected o the corresponding inner conductive layers 121*a*–121*d*.

The thickness of each of the conductive layers 121, 123, 125 and 131 is about 2 microns.

Figure 3:
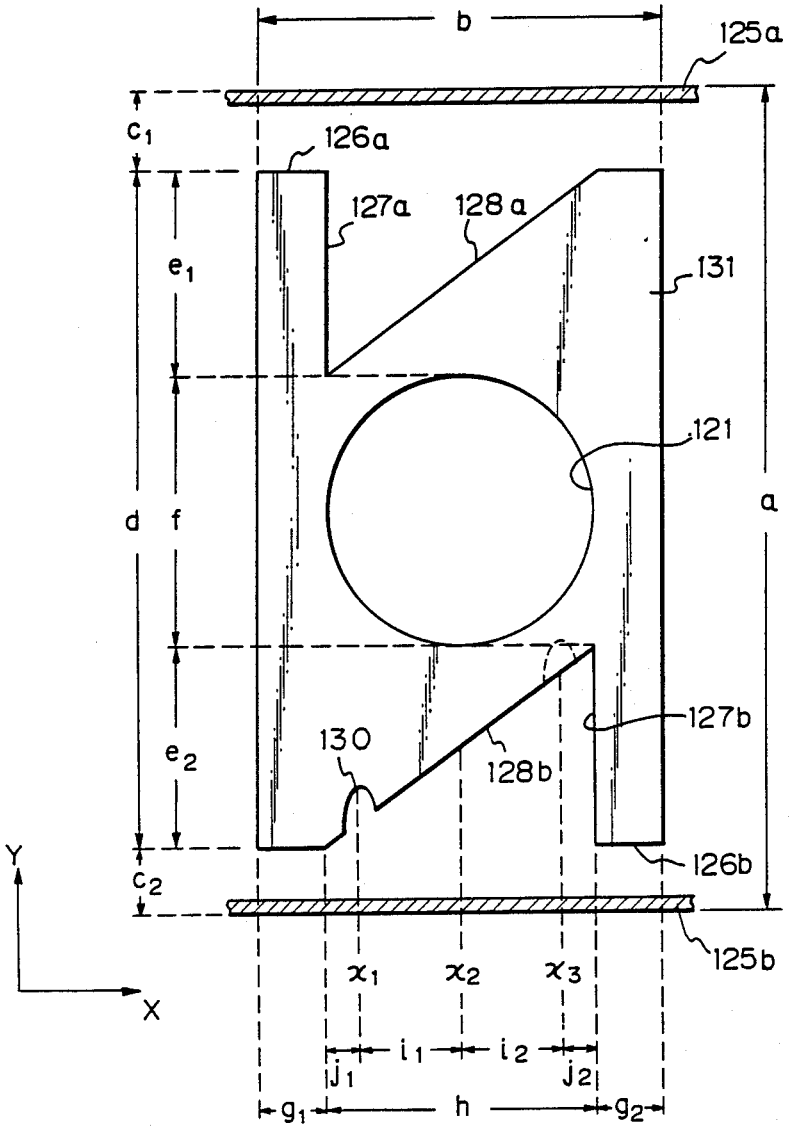
FIG. 3 is a partial plan view from the top of the dielectric filter in FIG. 1.

Referring to FIG. 3, there is illustrated a partial plan view of the filter 100 shown in FIG. 1. The exemplary top layer 131 as shown in FIG. 3 has a rectangular configuration, and has side edge portions 126*a* and 126*b* respectively facing the straight upper edge portions 125*a* and 125*b* of the side conductive layer 125. The side edge portions 126*a* and 126*b* are respectively provided with substantial identical right angled triangle shaped recesses 127*a* and 127*b*.

According to the first embodiment, the width (a) of the filter 100 is 6.00 mm; the width (b) of each top layer 131 is 3.00 mm; each of the distances (c1) and (c2) between the side portions 126*a*, 126*b* and the upper edge portions 125*a*, 125*b* is 0.5 mm; the length (d) of the top layer 131 is 5.00 mm; the depths (e1) and (e2) of the recesses 127*a* and 127*b* are each 1.50 mm; the diameter (f) of the inner conductive layer 121 is 2.00 mm; the lengths (g1) and (g2) of the sections of each of the conductive layer edge portions 126*a* and 126*b* which are parallel to the upper edge portions 125*a* and 125*b* is 0.50 mm; and the base (h) of each of recesses 127*a* and 127*b* is 2.00 mm.

The frequency response of a resonator having the above-mentioned structure can be adjusted by changing its capacitance which is mainly established between the upper edge portions 125*a* and 125*b* and the side edge portions 126*a* and 126*b* including the straight oblique edge portions 128*a* and 128*b* formed by the recesses 127*a* and 127*b*. The capacitance can be reduced by removing in the form of a notch 130 a portion of the conductive from the top conductive layer 131 by means of a sandblast trimmer or a laser trimmer.

The amount of reduction in the capacitance is determined by the location or locations of one or more such notches 130 along the oblique edge portions 128*a* and 128*b*, defined, for example, by its X-coordinate as measured along the upper edge portions 125*a* and 125*b* as shown in FIG. 3.

Figure 4:
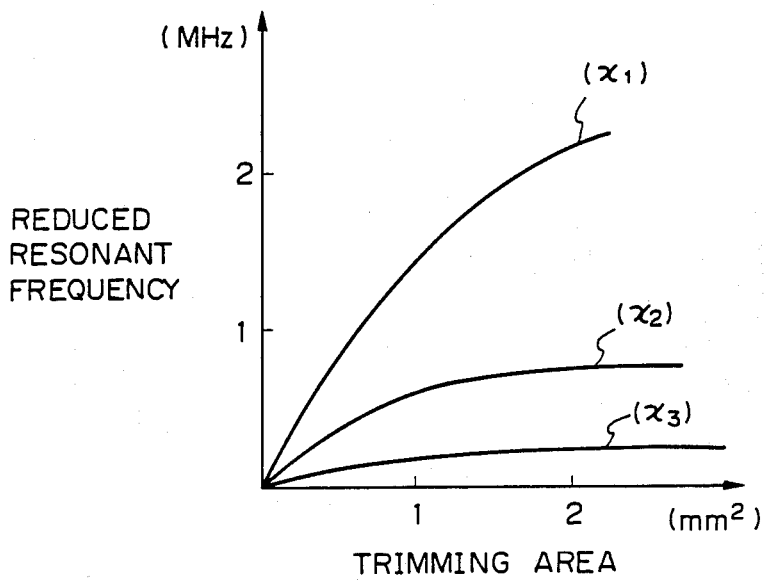
FIG. 4 is a graph illustrating the relation between the reduced resonant frequency and the trimming area according to the selection of the trimming portion from the edge portion of the top conductive layer in FIG. 3.

As shown in FIG. 4, in the case of removing conductive material at the location on the oblique edge portion 128*b* defined by the X-coordinate X1, the resonant frequency of the resonator is sharply reduced because the oblique edge portion 128*b* at X1 is relatively close to the upper edge portion 125*b* and, therefore, sets up a relatively large capacitance with the upper edge portion 125*b*. On the other hand, in the case of removing the conductive material from the oblique edge portion 128*b* at X3, the resonant frequency of the resonator is only slightly reduced because the oblique edge portion at X3 is relatively far from the upper edge portion 125*b* and, therefore, creates a relatively small capacitance with the upper edge portion. In the case of removing the conductive material from the oblique edge portion 128*b* at X2, the resonant frequency of the resonator experiences an intermediate reduction.

The resonant frequency of the resonator, therefore, can be adjusted within a large range of values by choosing a trimming location on an oblique edge portion and forming there a notch of a dimension previously selected independently of the location.

In the first embodiment shown in FIG. 3, the X-coordinates $X_1$ and $X_2$ are respectively distances $i_1$ and $i_2$ from the center location $X_2$ equal to 0.75 mm and distances $j_1$ and $j_2$ from the respective extremes of the oblique edge portion 128*b* equal to 0.25 mm The resonant frequency of the resonator in FIG. 3, of which the center frequency is around 880 MHz, is reduced by 2.0 MHz in the case of removing 1.57 $mm^2$ of the conductive material from the oblique edge portion 128*b* at the X-coordinate X1 and is reduced by 0.2 MHz in the case of removing 1.57 $mm^2$ of the conductive material from the oblique edge portion 128*b* at the X-coordinate X3.

There will now be described four additional embodiments of the invention which differ from the first embodiment only in the shape of each of the top surface conductive layers surrounding each of the holes 119.

Figure 5:
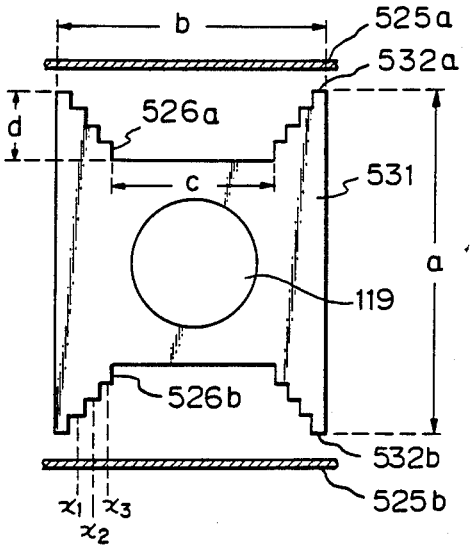
FIGS. 5–8 are partial plan views of other embodiments of the dielectric filter according to the present invention showing one of four identical holes in the filter and surrounding conductive layer.

Referring to FIG. 5, there is illustrated a second embodiment according to the present invention. The conductive layer 531 in FIG. 5 has a rectangular configuration, of which the length (a) is 5.00 mm, the width (b) is 4.0 mm, and side edge portions 532*a* and 532*b*, facing each of upper edge portions 525*a* and 525*b* are provided with respective regular trapezoid shaped recesses 526*a* and 526*b*. Each of the trapezoid shaped recesses has a short side (c) 2.40 mm long and a height (d) of 1.00 mm, and also has two staircase-shaped oblique sides, respectively consisting of four steps, each of the treads of which is 0.20 mm long and each of the risers of which is 0.25 mm high. The other dimensions of the resonator in FIG. 5 are substantially the same as those of the resonator shown in FIG. 3. The staircase-shaped oblique sides facilitate automation of the trimming process by reducing the need for precision in locating the X-coordinates where the notch is to be placed.

Figure 6:
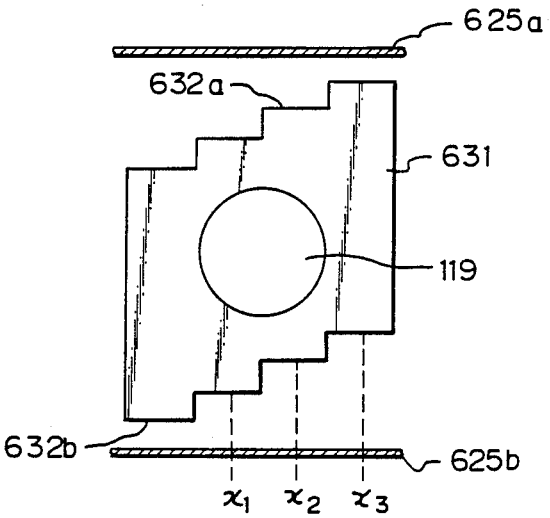

Referring to FIG. 6, there is illustrated a third embodiment according to the present invention.

The top conductive layer 631 in FIG. 6 has staircase-shaped edge portions 632*a* and 632*b* respectively facing upper edge portions 625*a* and 625*b*, each of four steps thereof defining a right-angle triangle-shaped recess. The tread of each of the steps is 1.0 mm long and the riser of each step is 0.40 mm high. The other dimensions of the resonator shown in FIG. 6 are substantially the same as those of the resonator shown in FIG. 5. This embodiment has a similar advantage to that of FIG. 5 in reducing the need for precision in locating where the notch is to be placed, particularly in an automated trimming process.

Figure 7:
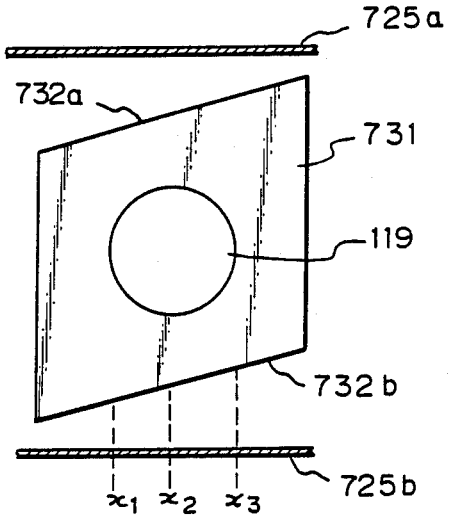
Figure 8:
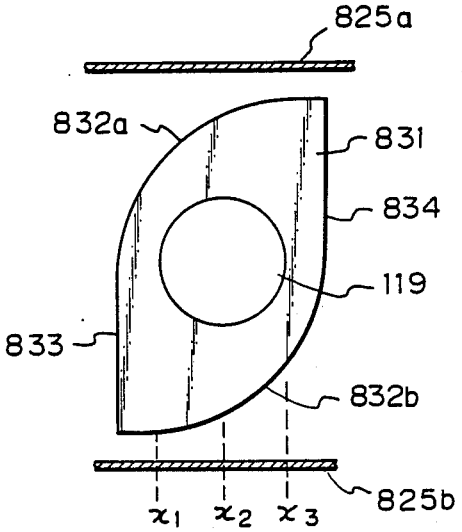

Referring to FIGS. 7 and 8, there are illustrated two other embodiments according to the present invention.

The conductive layers 731 in FIG. 7 has a parallelogram configuration, having a pair of edge portions 732*a* and 732*b* obliquely facing respective side conductive layer upper edge portions 725*a* and 725*b*.

The conductive layer 831 in FIG. 8 has a configuration in which edge portions 832*a* and 832*b*, respectively obliquely facing conductive side layer upper edge portions 825*a* and 825*b*, curve away from the latter edge portions from left to right and from right to left, respectively.

In each of the top conductive layers surrounding holes 119 according to the above-mentioned embodiments, locations along oblique edge portions have varying predetermined distances from the outer conductive layer edge portion. Thus, the resonant frequency of the resonator can be reduced from a relatively large amount to a relatively small amount by removing a predetermined same amount of the conductive material from a appropriately selected location along the oblique edge portion. The top surface of the filter is covered with a regular pattern of the conductive layers surrounding the holes to form with the upper edge portions 125*a* and 125*b* a plurality of resonators. Since there are no exposed portions of ceramic material on the top surface between the inner conductive layer and the top conductive layer little reduction of the unloaded Qu of the filter will occur.

The present disclosure relates to the subject matter disclosed in Japanese Application 62-198873 of August 8th, 1987, the entire disclosure of which is incorporated herein by reference.

It will be understood that the above description of the present invention is susceptible to various modifications, changes, and adaptations, and the same are intended to be comprehended within the meaning and range of equivalents of the appended claims.

What is claimed is:

1. A dielectric filter, comprising:

a dielectric block having a top surface, a bottom surface and a side surface extending from the top surface to the bottom surface, the dielectric block further having an interior surface defining a hole extending from the top surface to the bottom surface;

a side conductive layer covering the side surface;

a bottom conductive layer covering the bottom surface and electrically connected to the side layer, the side layer having an upper edge portion adjacent to the top surface;

a top conductive layer on a portion of the top surface surrounding the hole;

an inner conductive layer covering the interior surface so as to be electrically connected to the bottom layer at the bottom surface and the top conductive layer at the top surface, the top conductive layer being spaced from the side layer and having a side edge portion obliquely opposing and being capacitively coupled with the upper edge portion.

2. The dielectric filter according to claim 1, wherein the top conductive layer has a substantially right angle triangle-shaped recess and the side edge portion is formed by the hypotenuse side of the recess.

3. The dielectric filter according to claim 2, wherein the side edge portion has a staircase-shaped configuration.

4. The dielectric filter according to claim 1, wherein the top conductive layer has a regular trapezoid-shaped recess having two oblique sides and the side edge portion is formed along the two oblique sides.

5. The dielectric filter according to claim 4, wherein the side edge portion has a staircase-shaped configuration.

6. The dielectric filter according to claim 1, wherein the top conductive layer has a parallelogram configuration with the other two sides perpendicular to the upper edge portion and two sides oblique to the upper edge portion and the side edge portion is on one of the two oblique sides and obliquely facing the upper edge portion.

7. The dielectric filter according to claim 6, wherein the side edge portion has a staircase-shaped configuration.

8. The dielectric filter according to claim 6, wherein the side edge portion has a curled configuration.

9. A dielectric filter as in claim 1, wherein said block is rectangularly-shaped so that four side surfaces thereof extend from the bottom surface to the top surface, the side layer entirely covering the four side surfaces, the upper edge portion of the side layer surrounding the top surface, the interior surface having a cylindrical shape and being entirely covered by the inner layer, the top layer surrounding the hole.

10. A dielectric filter as in claim 1, wherein said hole is cylindrically shaped.

11. A dielectric filter, comprising:

a dielectric block having a top surface, a bottom surface and two opposite first side surfaces, the dielectric block further having a plurality of interior surfaces defining respective holes, the holes extending from the top surface to the bottom surface and being arranged between the two first side surfaces;

side conductive layers covering the two first side surfaces and a bottom conductive layer covering the bottom surface and electrically connecting the side layers, the side layer shaving an upper edge portion adjacent to the top surface;

a plurality of top conductive layers on respective portions of the top surface surrounding the respective holes;

inner conductive layers respectively covering the interior surfaces, the inner layer of each interior surface electrically connecting the bottom layer to the top layer surrounding the hole, each top layer having a side edge portion obliquely opposing the upper edge portion so as to be capacitively coupled with the upper edge portion, whereby the frequency response of the filter can be adjusted by removing a predetermined same amount of at least one of the top layers from a selected location along the side edge portion, the location being selected according to the amount of adjustment desired.

12. The dielectric filter according to claim 11, wherein the top conductive layers each have a substantially right angle triangle-shaped recess and the side edge portion is formed by the hypotenuse side of the recess.

13. The dielectric filter according to claim 12, wherein the side edge portions each have a staircase-shaped configuration.

14. The dielectric filter according to claim 11, wherein the top conductive layers each have a regular trapezoid shaped recess having two oblique sides and the respective side edge portion is formed along the two oblique sides.

15. The dielectric filter according to claim 14, wherein the side edge portions each have a staircase-shaped configuration.

16. The dielectric filter according to claim 11, wherein the top conductive layers each have a parallelogram configuration with two sides perpendicular to the upper edge portion and two sides oblique to the upper edge portion and the side edge portion is on one of the two oblique sides and facing the upper edge portion.

17. The dielectric filter according to claim 16, wherein the side edge portions each have a staircase-shaped configuration.

18. The dielectric filter according to claim 16, wherein the side edge portions each have a curled configuration.

19. A dielectric filter as in claim 11, wherein said block is rectangularly shaped and further has two second opposite side surfaces which extend from the bottom surface to the top surface, the side layer entirely covering the first and second side surfaces, the upper edge portion of the side layer surrounding the top surface, the plurality of holes being aligned in a line parallel to said first side surfaces, each of the interior surfaces having a cylindrical shape and being entirely covered by the inner layer, the top layers surrounding the respective holes.

20. A method of manufacturing a dielectric filter of selected resonant frequency values, the filter including a dielectric block having a top surface, a bottom surface, and two of opposite side surfaces, the dielectric block further having interior surfaces defining a plurality of holes extending from the top surface to the bottom surface between the side surfaces, the method comprising of the steps of:

(a) covering the side surfaces with a conductive material so as to produce a side conductive layer having an upper edge portion adjacent to the top surface;

(b) covering the bottom surface with conductive material so as to produce a bottom conductive layer electrically connecting the side conductive layer;

(c) covering respective spaced apart portions of the top surface surrounding the holes with conductive material so as to produce respective spaced apart top conductive layer portions thereon;

(d) covering each of the interior surfaces with conductive material so as to produce a plurality of inner conductive layers, each of the inner layers being electrically connected to the bottom layer and the respective top layer portions, each of the top layer portions having a side edge portion obliquely facing the upper edge portion so that the side edge portion is capacitively coupled with the upper edge portion, so as to produce a dielectric filter having resonant frequencies greater than the selected resonant frequency values;

(e) measuring the resonant frequencies of the filter; and (f) removing a predetermined amount of the conductive material from respective selected portions of the side edge portion depending on the measured resonant frequencies, so as to reduce the resonant frequencies of the filter to the preselected resonant frequency values.

21. A method of manufacturing a dielectric resonator of selected resonant frequency value, the resonator including a dielectric block having a top surface, a bottom surface, and a side surface, the dielectric block further having an interior surface defining a hole extending from the top surface to the bottom surface, the method comprising the steps of:

(a) covering the side surface with a conductive material so as to produce a side conductive layer having an upper edge portion adjacent o the top surface;

(b) covering the bottom surface with conductive material so as to produce a bottom conductive layer electrically connecting the side conductive layer;

(c) covering a portion of the top surface surrounding the hole with conductive material so as to produce a top conductive layer portion thereon;

(d) covering the interior surface with conductive material so as to produce an inner conductive layer, the inner layer being electrically connected to the bottom layer and the top layer portion, the top layer portion having a side edge portion obliquely facing the upper edge portion so that the side edge portion is capacitively coupled with the upper edge portion, so as to produce the dielectric resonator having a resonant frequency greater than the selected resonant frequency value;

(e) measuring the resonant frequency of the resonator; and (f) removing a predetermined amount of the conductive material from a selected portion of the side edge portion depending on the measured resonant frequency, so as to reduce the resonant frequency of the resonator to the preselected resonant frequency value.

* * * * *